US009057207B1

(12) United States Patent
Prendergast

(10) Patent No.: US 9,057,207 B1
(45) Date of Patent: Jun. 16, 2015

(54) MULTI-PURPOSE RECREATIONAL TENT

(71) Applicant: Michael Prendergast, Mattituck, NY (US)

(72) Inventor: Michael Prendergast, Mattituck, NY (US)

(73) Assignee: Kid Agains, inc., Mattituck, NY (US)

( * ) Notice: Subject to any disclaimer, the term of this patent is extended or adjusted under 35 U.S.C. 154(b) by 0 days.

(21) Appl. No.: 14/267,312

(22) Filed: May 1, 2014

(51) Int. Cl.

| | |
|---|---|
| ***E04H 15/02*** | (2006.01) |
| ***E04H 15/34*** | (2006.01) |
| ***E04H 15/00*** | (2006.01) |
| *E04H 15/42* | (2006.01) |

(52) U.S. Cl.
CPC ..... *E04H 15/34* (2013.01); *E04H 15/006* (2013.01); *E04H 15/425* (2013.01)

(58) Field of Classification Search
CPC ..... E04H 15/006; E04H 15/425
USPC ..... 135/124, 128, 137, 156, 117; 473/162, 473/173, 195, 197, 446, 454, 476, 478, 479, 473/136, 137; 273/398, 401, 402, 404, 407, 273/408, 410
See application file for complete search history.

(56) References Cited

U.S. PATENT DOCUMENTS

| | | | | |
|---|---|---|---|---|
| 39,416 | A * | 8/1863 | Moakly | 135/94 |
| 2,823,034 | A | 2/1958 | Bingham, Jr. | |
| 2,988,360 | A * | 6/1961 | Lambiotte | 273/396 |
| 4,815,736 | A | 3/1989 | Wright | |
| D343,688 | S * | 1/1994 | Jason | D25/16 |
| 5,312,109 | A | 5/1994 | Cagle | |
| 5,409,230 | A | 4/1995 | Dunaway et al. | |
| 5,439,018 | A * | 8/1995 | Tsai | 135/143 |
| 5,984,793 | A * | 11/1999 | Palombi | 473/195 |
| 6,394,918 | B1 | 5/2002 | Erhard | |
| 6,481,451 | B1 * | 11/2002 | Zheng | 135/126 |
| 6,939,255 | B2 | 9/2005 | Peterson | |
| 7,549,433 | B2 * | 6/2009 | Zheng | 135/126 |
| 7,721,747 | B2 | 5/2010 | Habing | |
| 2002/0049103 | A1 * | 4/2002 | Treihart | 473/454 |
| 2002/0050285 | A1 * | 5/2002 | Zheng | 135/126 |
| 2002/0108646 | A1 * | 8/2002 | Hotes | 135/124 |
| 2003/0066553 | A1 * | 4/2003 | Zheng | 135/126 |
| 2013/0104947 | A1 * | 5/2013 | Hotes et al. | 135/96 |
| 2013/0206197 | A1 * | 8/2013 | Hotes et al. | 135/96 |
| 2014/0145401 | A1 * | 5/2014 | Powers et al. | 273/402 |
| 2014/0155183 | A1 * | 6/2014 | Niu | 472/136 |
| 2014/0274490 | A1 * | 9/2014 | Niu | 473/478 |

FOREIGN PATENT DOCUMENTS

| | | | |
|---|---|---|---|
| CH | 618083 | A * | 7/1980 |

* cited by examiner

*Primary Examiner* — Robert Canfield
(74) *Attorney, Agent, or Firm* — Thomas A. O'Rourke; Bodner & O'Rourke, LLP

(57) ABSTRACT

The present invention relates to a multi-purpose recreational tent that allows a user to participate in a wide array of games and other activities inside or outside of the tent. The games and activities that may be played include but are not limited to soccer, baseball, basketball, hockey, football, golf, tennis, volleyball, field hockey, lacrosse, and badminton.

15 Claims, 6 Drawing Sheets

MULTI-PURPOSE RECREATIONAL TENT

CROSS-REFERENCE TO RELATED APPLICATION

This application claims priority on U.S. Provisional Patent Application Ser. No. 61/817,932, filed on May 1, 2013, the disclosures of which are hereby incorporated by reference.

FIELD OF THE INVENTION

The present invention relates to a multi-purpose recreational tent that allows for the enjoyment of a variety of activities.

BACKGROUND OF THE INVENTION

Encouraging physical activity among people of all ages, and in particular, children of all ages is very important. Many people in today's society do not engage in enough daily physical activity which places themselves at risk of developing health complications. For example, the percentage of people afflicted with diabetes has steadily increased and theories have been presented that the rise may be related to an increased lack of physical activity. In addition to having a possible negative effect on a person's physical health, an increased lack of activity can also take a toll on a person's mental health.

One possible cause for the lack of physical activity may be the lack of environments that encourage activities. The present invention aims to address and alleviate this problem by providing a recreational tent that allows one or more users to engage in a variety of activities.

OBJECTS OF THE INVENTION

It is an object of the present invention to provide a multi-purpose recreational tent that allows one or more users to engage in a variety of activities.

It is another object of the present invention to provide a multi-purpose recreational tent that encourages one or more users to engage in more daily physical activity.

It is an even further object of the present invention to provide a multi-purpose recreational tent that is easy and convenient to construct and deconstruct.

It is still yet an even further object of the invention to provide a multi-purpose recreational tent that includes features on the inside and outside of the tent for one or more users to interact.

SUMMARY OF THE INVENTION

The present invention relates to a multi-purpose recreational tent to allow one or more users to engage in a variety of recreational activities, such as sports related and non-sports related activities, inside or outside of the tent. The tent generally comprises a front end wall, a back end wall, a first side wall extending from the first end of the front wall to the first end of the back wall, a second side wall extending from the second end of the front wall to the second end of the back wall, and a cover that extends from at least the first sidewall to the second sidewall to cover at least a portion of the enclosed area defined by the walls of the tent. The tent may also include at least one entranceway to the inside of the tent. The entranceway may be in the form of an opening located on one or more of the walls and/or cover. The opening may be covered by a flap, may have no cover at all, may have a door hinged to the opening, etc.

Further, at least one cutout may be present in one or both of the end walls, and the at least one cutout may be centrally located to allow a user to interact with the cutout in the enjoyment of the game or other activity. The cutout may resemble the shape of a goal, such as a soccer goal, and may have a net or other means secured to it for capturing an object, such as a ball or other projectile that is projected through the cutout. Further, at least a portion of the front and/or back end wall that is above and/or adjacent to the at least one cutout may comprise a net or mesh surface to block errantly shot or thrown projectiles and to provide ventilation and sunlight. There may also be one or more cutouts in the side walls and/or cover in addition to the centrally located cutouts in one or both of the end walls. One or more of the cutouts may have a mesh or transparent screen bridging their length or there may be no mesh or transparent screen such that the interior of the tent and the exterior environment are communicable without any barriers. The cutouts may be used in practicing accuracy or playing a game by, for example, throwing or shooting a football, baseball, volleyball, basketball, hockey puck, soccer ball, or other projectile through the cutouts.

The inside area of the tent may have one or more adjustable panels for dividing the inside area into one or more different play areas. The panels may be secured to the inside surface of the tent by known means in the art and may be slidable along a track on the inside surface of the tent to extend the panels and divide the inside of the tent into different areas. Further, at least one net may be removably or non-removably secured to a wall and/or cover of the tent and may be extended and secured to a directly opposite point or other point such that a net is now present in the enclosed area. The net may allow for the enjoyment of a game of volleyball, badminton, tennis or other desired game that utilizes nets. There maybe different connection points for the net on the inside surface of the tent walls and cover that correspond to a particular game to be played. For example, connection points located at a higher point on the walls and/or cover of the inside of the tent preferably correspond to a game of volleyball or badminton while lower connection points preferably correspond to a game of tennis.

In an even further embodiment, there may be one or more nets or panels on the inside surface of the tent that may be slidable along a track for creating an indoor batting cage area. There may also be at least one basketball backboard and rim removably secured to at least one of the walls of the tent. It is to be appreciated by those skilled in the art, however, that the tent is also designed to allow any external objects to be brought inside of the tent to allow a desired game to be played. The external objects include but are not limited to a basketball hoop, a tennis net, a volleyball net, a ping pong table, pool table, air hockey table, etc.

The outside surface of the present invention's recreational tent may have one or more target areas for receiving a projectile, such as a golf ball, football, baseball, tennis ball, soccer ball, lacrosse ball, volleyball, field hockey ball, hockey puck, and other projectiles used in games. The target areas may be rings in one embodiment and may serve as a practice aid for a user that allows a user to improve accuracy, for example, when hitting a golf ball, throwing a football or baseball, kicking a soccer ball, shooting a hockey puck or ball, etc.

The walls and cover to the tent are preferably supported by frame members by being removably or non-removably secured to the frame members. The frame members may support the walls and cover of the tent in a similar fashion to tents currently known and used in the art for camping. The frame members may preferably be poles and may be comprised of fiberglass, aluminum, or other materials used in the art. The poles may be coupled to the inside or outside of the tent by clips, hooks, etc. Alternatively, the poles may be coupled within the tent by enclosed channels in the tent walls and cover.

Further, the walls and cover of the tent may preferably be one unitary structure that may be translucent and that may be made of a breathable nylon material. The nylon material may be a rip-stop nylon material for better durability and the nylon material may also be coated with a waterproofing agent. It is to be appreciated by those skilled in the art, however, that other materials may be used for the tent walls and/or cover and that these materials may have a breathable and/or waterproofing feature as well.

At least a portion of at least one of the walls and/or cover may have one or more layered areas. The layered areas may each cover one or more additional layers that may be present in the tent walls and/or cover. The layered area is preferably openable to expose the additional layers. One or more of the additional layers may also be openable. For example, one of the additional layers may be a mesh window screen to provide ventilation and allow sunlight to enter the enclosure. An additional area covered by the panel may be a transparent screen that is not mesh in nature and that does not contribute significantly to ventilation but that may be used for allowing a higher concentration of sunlight to enter the enclosure. In one embodiment, the layered area may cover a transparent screen and the transparent screen may cover the mesh screen. Here, a panel may be opened to expose the transparent screen, and the transparent screen may also be opened to expose the mesh screen. The mesh screen may further be opened so that there is no barrier between the inside and outside environment. In an alternate embodiment, the mesh screen may be sandwiched between the transparent screen and the panel area. In this embodiment, the layered area may be opened from the outside of the tent and the transparent screen may have a means for opening it from the inside of the tent to allow for the mesh screen to provide ventilation to the inside of the tent.

In other embodiments, each panel may cover either a transparent screen or a mesh screen; or there may be only panels covering mesh screens or only panels covering transparent screens. Even further, the whole surface of one or more of the walls and the cover of the tent may be layered and there may be opening means positioned in a variety of the same or different locations of each layer to allow a user to open a desired area of the layer to exposed a layer covered by the opened layer. For example, a user may open a desired area of the outside layer of the tent, such as the whole area of one of the side walls of the tent, to expose the mesh layer, the transparent layer, or another additional layer that may be present in the tent.

The panel and/or additional areas may be opened by zippers, by a hook and loop fastening system, or by any other means currently used in the art. There may be a retaining means on the tent walls and/or cover for retaining the panel flaps once the paneled area has been opened. The retaining means may be a strap secured to the tent wall and/or cover that may retain the panel flap in place by, for example, snapping onto a snap receiving means on the interior surface of the panel. Other retaining means may also be used, such as but not limited to buckle means, hook and loop fastening means, etc.

In another embodiment for retaining the flaps of the panel and/or additional layers, there may be retaining means on the flaps of the panel and additional layers that mate with complementary retaining means on the outside surface of the tent that is outside of the opened panel area, such as snap lock means, hook and loop fastening means, buckle means, etc. Further one or more of the additional layers, when opened, may be secured to the opened layer that directly covers it and the top most layer, i.e., preferably the translucent outside surface of the tent, may be secured to another point on the outer translucent surface that is outside of the panel area.

In further embodiments, one or more of the layered areas may consist of the whole area of one or more walls or the whole area of the cover. For example, a panel area may be the whole area of the first side wall of the tent and a user may open the panel area by unzipping, etc. the panel area to expose the additional layer underneath, such as a mesh screen. The flap that is formed by opening the panel may be secured to the tent by folding the flap and securing points on the flap that have retaining means to complementary points on other surfaces of the remaining tent walls and/or cover. There may also be one or more pouches present in the tent walls and/or cover for storing the flap of an opened panel and/or opened additional layer.

The walls of the tent preferably combine to form a square-like enclosed area but other shapes are contemplated. In addition, the cover preferably extends from the top edge of one of the side walls to the top edge of the opposite sidewall. The cover preferably resembles an arced cover but other shapes used in the art are also contemplated.

The recreational tent of the present invention is designed to promote a more active lifestyle for people of all ages, and, in particular, children of all ages by allowing a user to participate in a wide variety of activities inside or outside of the tent, which include but are not limited to football, golf, baseball, soccer, basketball, volleyball, tennis, lacrosse, hockey, tennis, badminton, field hockey. In addition, the tent may serve as a gym and weight training equipment may be stored inside of the tent. Even further, lights may also be removably or non-removably secured to any interior surface of the tent.

DETAILED DESCRIPTION OF THE INVENTION

Figure 1:
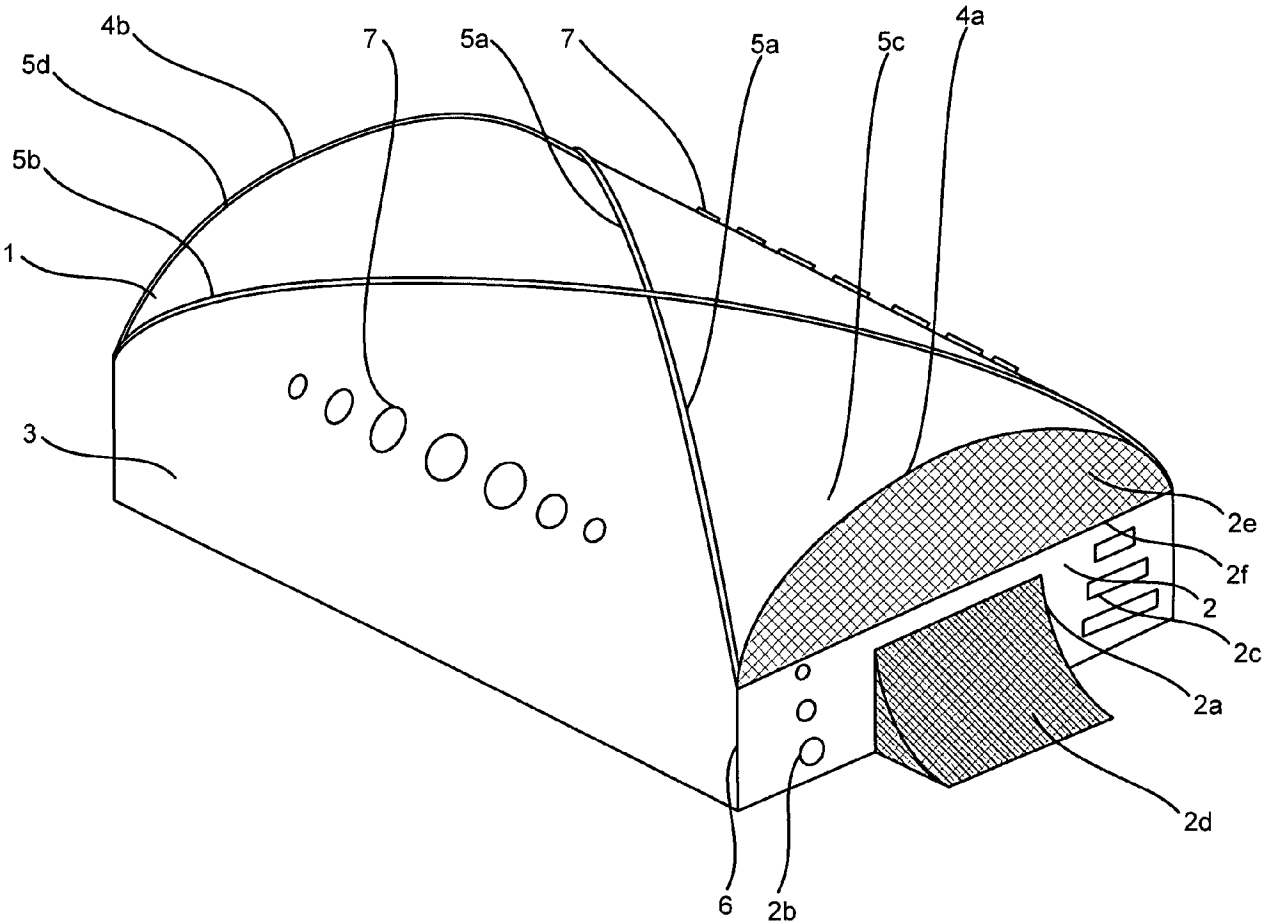
FIG. 1 is a perspective view of the exterior of the multi-purpose recreational tent of the present invention.

FIG. 1 shows a perspective view of a detailed embodiment of the exterior of the multi-purpose recreational tent 1 of the present invention which comprises a front end wall 2, a first side wall 3 extending from a first end of the front end wall 2 to a first end of a back end wall (not shown), a second side wall (not shown) extending from a second end (not shown) of the front end wall 2 to a second end (not shown) of the back end wall (not shown), and an arced cover 4 extending from the entire length of a top edge of the first side wall to the entire length of a top edge of the second side wall (not shown). The walls and cover combine to form a rectangular shaped tent enclosure with an arced cover.

The sidewalls and arced cover in the embodiment seen in FIG. 1 combine to form a single unitary structure that resembles an inverted U-shaped member. However, in other embodiments, the cover may be a separable structure from the sidewalls and may combine with the sidewalls to form a different structure. Further, the separable covers in these alternate embodiments may have at least a portion that is removable from the sidewalls or the entire cover may not be removable from the sidewalls. In other embodiments, the cover may be a different shape than arced, such as flat, triangular, or other shapes used in art.

Further, a plurality of frame members, preferably in the form of poles, are used to the support the tent in its opened configuration. In particular, the tent in the embodiment of FIG. 1 includes frame members that extend from each corner of the tent 1. There is a first frame member 5*a* that extends from the corner of the connection 6 between the first side wall 3 and the front end wall 2 to the corner of the connection between the back end wall (not shown) and the second side wall (not shown). A second frame member 5*b* is also present and extends from the corner connection (not shown) between the first side wall 3 and the back end wall (not shown) to the corner connection (not shown) between the second side wall (not shown) and the front end wall 2. A third frame member 5*c* is further present and extends from the corner connection 6 between the first side wall 3 and the front end wall 2, along the front edge 4*a* of the arced cover 4, to the corner connection (not shown) between the second side wall (not shown) and the front end wall 2. Finally, a fourth frame member 5*d* extends from the corner connection (not shown) between the first side wall 3 and the back end wall (not shown), along the back edge 4*b* of the arced cover 4, to the corner connection (not shown) between the second side wall (not shown) and the back end wall (not shown).

In the embodiment of FIG. 1, the first and second frame members 5*a* and 5*b* diagonally extend across the tent and intersect at their respective centers. In other embodiments, however, the framer members may be positioned differently. For example, the third and fourth frame members may be present without the first and second frame members and there may be at least one additional frame member that extends parallel to the third and fourth frame members from a central point on the first side wall to a directly opposite central point on the second side wall. In other embodiments there may be a plurality of frame members extending in parallel between the third and fourth frame members. Other configurations, however, for positioning frame members on tents are also possible.

A plurality of target areas 7 may be located on the cover above the transition of the tent from the first side wall 3 to the cover 4 and above the transition of the tent from the second side wall (not shown) to the cover 4. The target areas 7 are differently sized rings in this embodiment that are centrally located between the front and back of the tent but other locations are also possible. Further, there are 7 rings in this embodiment but more or less rings may be used. In addition, the target areas may be targets, such as archery targets, painted on the surface of the tent rather than rings. Other types of targets used in the art are also contemplated to be used rather than or in addition to rings.

The front end wall 2 of the tent includes a centrally located cutout 2*a* with a plurality of differently sized and vertically arranged circular cutouts 2*b* disposed midway between the first end of the front wall and an end of the centrally located cutout; and a plurality of differently sized and vertically arranged rectangular cutouts 2*c* disposed midway between the second end of the front end wall and the opposite end of the centrally located cutout 2*a*. The centrally located cutout is in the form of a rectangle and has a net 2*d* secured to its edges. The centrally located cutout may function as a goal for the enjoyment of a game, such as but not limited to a soccer goal, a field hockey goal, a hockey goal, etc. The plurality of differently sized cutouts 2*b* and 2*c* may serve as additional goals for a game or may also serve as accuracy practice targets. There may also be a mesh screen or net secured to the plurality of different sized cutouts 2*b* and 2*c* (e.g., net 2*m* shown for one of the cutouts 2*c* in FIG. 2), or no screen at all such that there is no barrier between the inside of the tent and the external environment between the cutouts 2*b* and 2*c*. Further, the centrally located cutout 2*a* and the plurality of differently sized cutouts 2*b* and 2*c* may also provide ventilation to the tent.

The tent of the present invention may also include a mesh screen 2*e* that extends from the top edge 2*f* of the front end wall to the interior surface of the cover 4 near the cover's front edge 4*a*. The front end wall mesh screen 2*e* provides ventilation and allows additional sunlight to enter the tent. In alternate embodiments, the mesh screen may be larger or smaller than in FIG. 1; or there may be no mesh screen at all and the area may be opened such that no barrier is present or the front end wall may extend to the bottom of the cover near the cover's front edge. Even further, all or a portion of the mesh screen may be removable by zippers, hook and loop fastening strips, and other known means if a user does not desire all or a portion of the mesh screen to be present.

The back end wall is not shown in FIG. 1 but in the FIG. 1 embodiment the back end wall is preferably a mirror image of the front end wall as shown in FIG. 1. In addition, in other embodiments, the back end wall may always mirror the front end wall in that particular embodiment or it may not mirror the front end wall and may be a solid wall with no openings.

The tent may be designed to be collapsible, such that the frame members may be linked together in a similar fashion as camping tent poles, i.e., with elastic shock cords. The frame members also may have pivots and/or joints to conform to the shape of the tent. Further, stakes or other anchoring means may be used to secure the tent to a surface. The stakes may be secured to the tent frame members and/or the surface of the tent by means known in the art, such as but not limited to clips and/or hooks.

Figure 2:
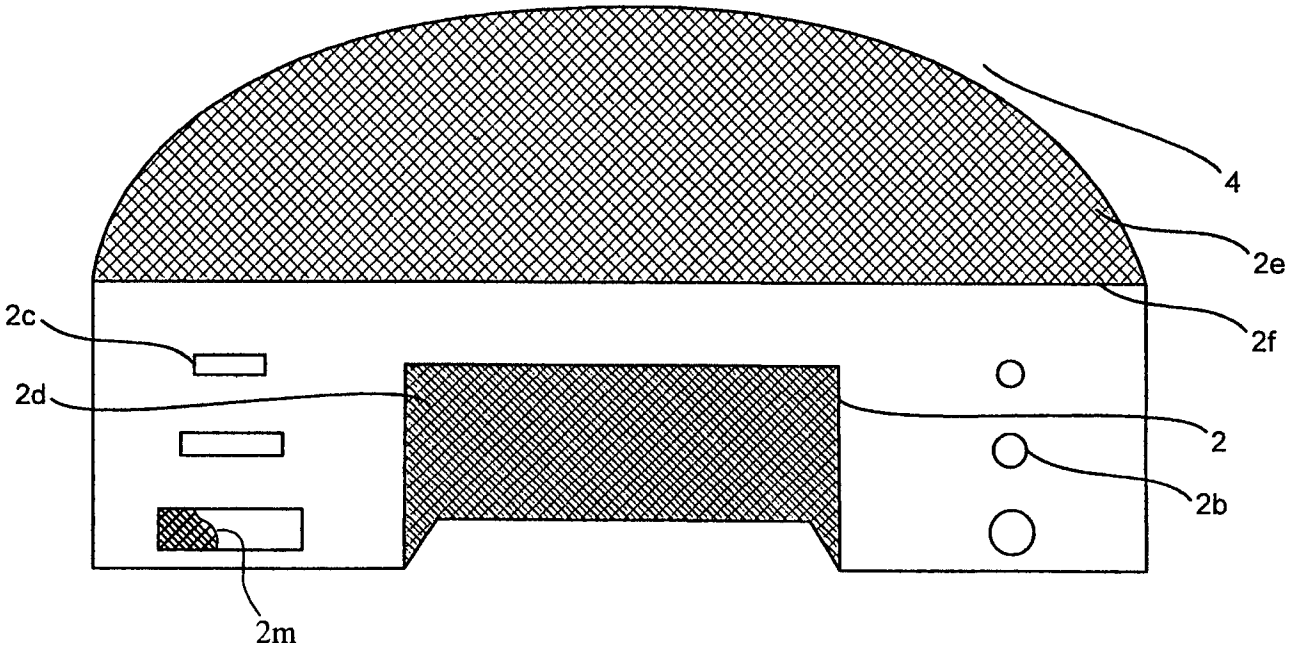
FIG. 2 is an end view of the interior of the multi-purpose recreational tent of FIG. 1 that shows one end wall and a portion of the cover.
Figure 2A:
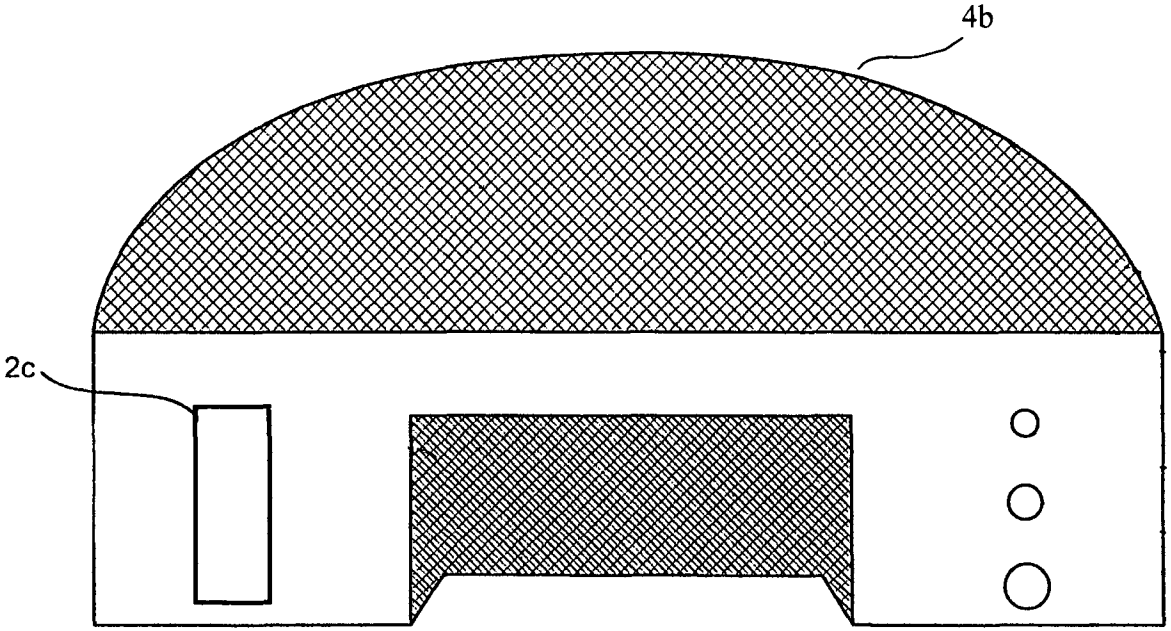
FIG. 2A is an end view of the interior of the multi-purpose recreational tent of FIG. 1 that shows the second end wall constructed substantially similar to the first end wall, but where there is only one rectangular cutout that is extended downward, which may serve as an entranceway.

FIG. 2 shows a perspective view of the interior of the multi-purpose recreational tent of FIG. 1. Shown is the front end wall 2, the centrally located cutout 2*a* with the net secured thereto 2*d*, the plurality of different sized cutouts 2*b* and 2*c*, the mesh screen 2*e* above the top edge 2*f* of the front end wall, and the interior surface of the cover 4.

Further, at least a portion of the inside surface of the cover may be removable to expose a non-mesh screen or a mesh screen layer to provide ventilation and/or sunlight to the inside of the tent. The removable portion, a panel, may be secured to the inside surface of the cover by zippers, hook and loop fastening means, snap lock means or other means used in the art. The panel may be removed to expose the screen or mesh layer that is already in place spanning the orifice exposed by the removing the cover; or the screen or mesh layer may be in a stored non-extended position that is then extended to cover the open orifice once the panel has been removed. When the screen or mesh layer is extended to cover the open orifice, it may be secured to the orifice's surrounding edge by a zipper means, by a hook and loop fastening means, by snap lock means or by other means used in the art. The screen or mesh layer may be stored in a non-extended position by having straps securing the screen or mesh layer in a rolled configuration. The rolled configuration may be located adjacent to the orifice that the screen or mesh layer will cover once the panel is removed or may be located in any other location on the inside or outside surface of the cover or walls. There may be more than one removable panel located throughout the cover's interior surface and the panels may be of varying sizes and shapes such as but not limited to square, rectangular, circular, ovular etc. The panel may have one end still secured to the cover such that a flap is created when the remaining ends of the panel are removed from the cover. The flap may be folded through the orifice created by the removed panel either to the inside or outside surface of the tent cover and secured thereto by securing means used in the art or disclosed herein. The mesh or screen layer may also have one end that is non-removable from the cover. The non-removable end is preferably adjacent to the orifice created by the removable panel. When the orifice is created, the mesh or screen layer may be extended and secured to the orifice to cover the orifice. The securing means may be by any means used in the art or disclosed herein. The area adjacent the orifice may include the non-mesh screen and mesh screen secured at different points to allow a user to choose between using a mesh or non-mesh material.

In a particular embodiment of the invention, the cover may comprise a removable panel located in a substantially central location at the top of said cover. The location of the panel may be such that it is directly opposite to the central point of the enclosure formed by the tent's walls. The panel may be boxed shape and may be removably secured to the cover by a zipper. When the panel is removed, an orifice is created in the cover where the panel was secured. A mesh layer may be stored in a non-extended rolled configuration by straps. The mesh roll may be placed on the inside or outside surface of the cover near an edge of the orifice. The straps to secure the mesh roll may have a first end that extends from the cover, a body portion that extends over the mesh roll to retain the mesh roll in a rolled configuration, and a second end that is removably secured to the cover by snap lock means or other removable means used in the art or described herein. The first end of the strap may further be removably or non-removably secured to the cover.

To remove the mesh roll from the straps, the second end of the strap may be removed from the cover and the roll removed. The mesh roll may then be unrolled and secured to the surrounding edge of the orifice by a zipper means. Further, a non-mesh transparent screen may be stored on the cover near an edge of the orifice in a different location than the mesh roll. The screen may be stored in a rolled configuration in the same way as the mesh roll and the screen may be removable with securing straps in the same way as the mesh roll. In this way, a user will have the option of using a screen to only provide sunlight to the inside of the tent or a mesh layer to provide sunlight and ventilation to the inside of the tent. In this embodiment, the mesh and non-mesh screen are separate articles from the cover such that they are completely removable from the cover. In other embodiments, however, one end of the non-mesh screen and/or mesh screen may be secured to the orifice at different points that surround the orifice such that the mesh or non-mesh screen may be extending over the orifice and the remaining portions of the mesh or non-mesh screen secured to the orifice by means known in the art or described herein.

Figure 3:
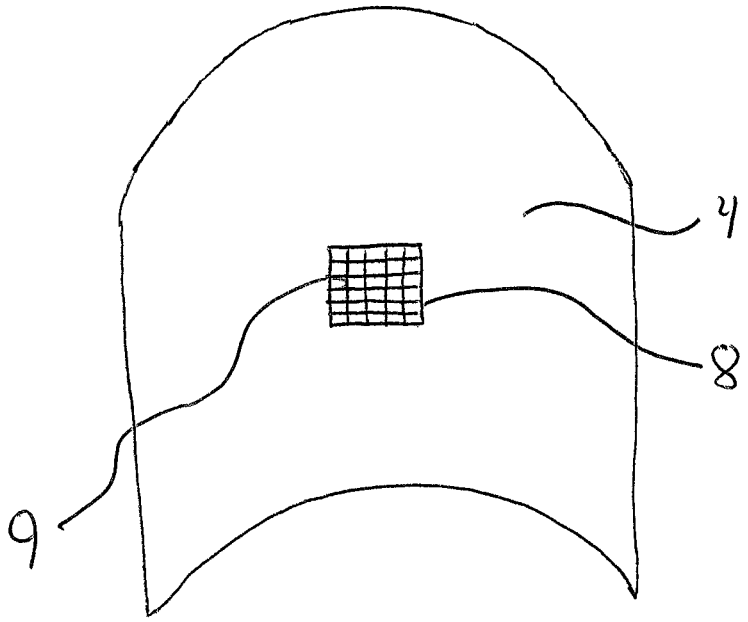
FIG. 3 is a perspective view of the exterior of the tent cover that includes an orifice having a mesh screen.

FIG. 3 shows a perspective view of the outside surface of the tent cover 4. Here, the outside surface of the tent cover 4 comprises an orifice 8 formed by removing a panel of the cover. The orifice includes a mesh screen insert 9 to provide ventilation and sunlight to the inside of the tent. Where the tent includes frame members, the frame members may be oriented as such to not intersect over the mesh screen or the frame members may be positioned as in FIG. 1 and intersect over the mesh screen. It is further to be appreciated by those skilled in the art that the orifice may be in a different location on the cover or any of the walls than as seen in FIG. 3 and there may be more than one orifice present with a mesh or non-mesh screen being used. Further, the screen insert may be a combination of a mesh and non-mesh screen such that a portion of the screen provides ventilation means while the other portion only allows the passage of sunlight. The mesh or non-mesh nature of the dual mesh/non-mesh screen may be adjustable such that the mesh portion may occupy a greater area of the screen than the non-mesh portion when ventilation is desired.

Figure 4:
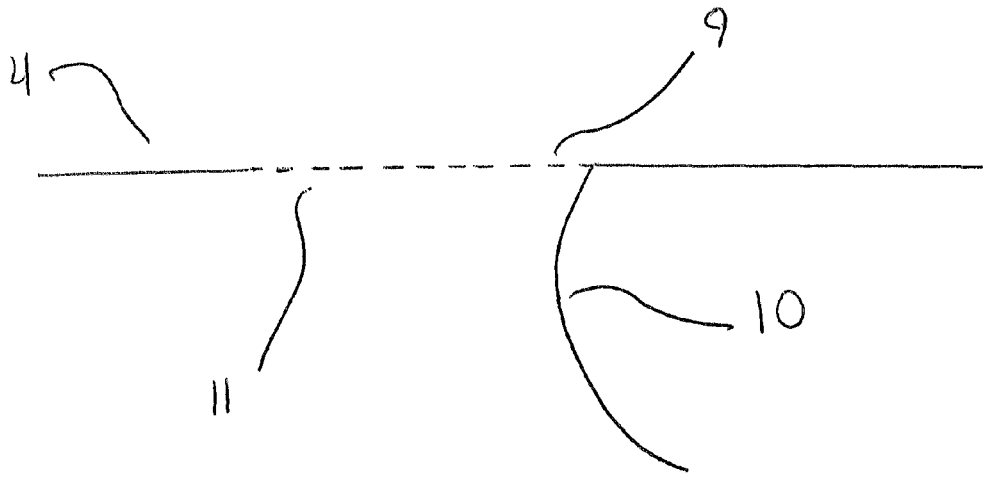
FIG. 4 shows a sectional view of the tent cover with a mesh screen and the flap of the removed panel.

FIG. 4 shows a sectional view of the panel 10 being removably hinged to the cover and being in a removed position. Here, the mesh screen 9 is secured in place over the orifice created by the removed panel.

Figure 5:
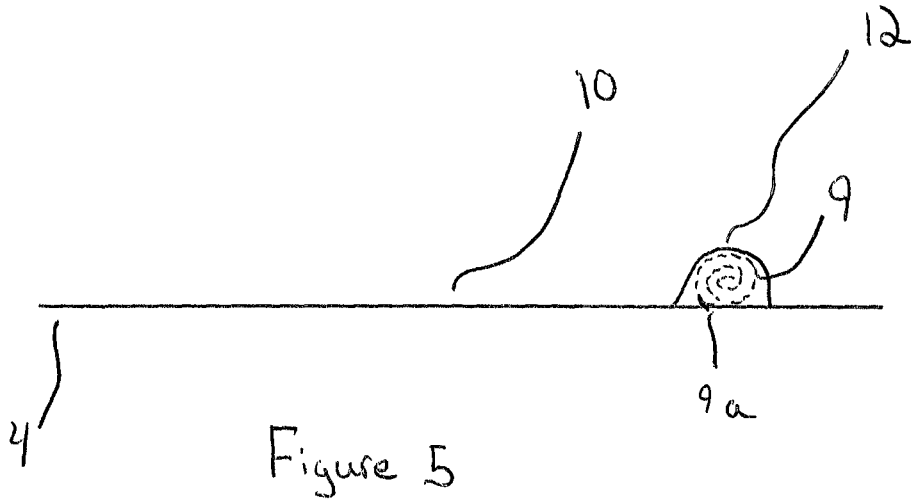
FIG. 5 shows a side view of the tent cover that includes a mesh screen stored in a rolled configuration next to a removable panel on the cover.

FIG. 5 shows a view of the tent cover 4 with the panel in a non-removed position and the mesh screen 9 secured to the surface of the tent cover by a strap 12. Here, the mesh screen is secured to the outside surface of the tent cover but in other embodiments it may be secured to the inside cover. The mesh screen here also extends from a point 9*a* the surface of the tent cover that is adjacent to the removable panel.

The tent may also include pouches in the cover rather than or in addition to the straps that may receive and store the mesh and non-mesh screens when they are not in use. Further, the tent may also include removable covers for the other cutouts on the end walls and cover to promote warmth inside of the tent on a colder day. The covers may be stored in pouches or pockets located on the tent's inside or outside surface. The covers may also be stored in a rolled configuration as the mesh and non-mesh screen roll.

What is claimed is:

1. A multi-purpose recreational tent comprising:

a front end wall, a back end wall, a first side wall extending from a first end of the front end wall to a first end of the back end wall, a second side wall extending from a second end of the front end wall to a second end of the back end wall, and a cover secured to the top edge of said end walls and said side walls to cover at least a portion of the enclosure formed by the end walls and side walls, wherein a lower portion of at least one of said end walls comprises a centrally located cutout for the interaction of a user, a first plurality of vertically spaced apart cutouts disposed about midway between an end of said end wall and an end of said cutout, and a second plurality of vertically spaced apart cutouts disposed about midway between an opposite end of said end wall and an opposite end of said centrally located cutout, said first and second plurality of cutouts allowing for the interaction of a user, wherein at least a portion of the exterior surface of the cover comprises a plurality of spaced apart and differently sized target areas for the interaction of a user, at least a portion of said cover further being removable to create an orifice in said cover, said orifice receiving a screen to allow sunlight and/or ventilation into the inside of the tent, and wherein at least one of said walls comprises an entrance-way into the interior of said tent.

2. The multi-purpose recreational tent according to claim 1 wherein said cover is in the shape of the arc of a circle.

3. The multi-purpose recreational tent according to claim 2 wherein said plurality of target areas are located on said cover near the point of extension of said cover from one of said side walls.

4. The multi-purpose recreational tent according to claim 3 wherein a net for receiving a projectile is secured to the surrounding edge of each of said plurality of target areas.

5. The multi-purpose recreational tent according to claim 4 wherein said plurality of target areas are in the shape of differently sized rings.

6. The multi-purpose recreational tent according to claim 3 wherein a second plurality of target areas are located on said cover near the point of extension of said cover from a second of said side walls.

7. The multi-purpose recreational tent according to claim 6 wherein a net for receiving a projectile is secured to the surrounding edge of each of said second plurality of target areas.

8. The multi-purpose recreational tent according to claim 3 wherein a net is secured to the surrounding edge of said centrally located cutout.

9. The multi-purpose recreational tent according to claim 3 wherein at least a portion of an upper area of said sidewall having said cutouts comprises a mesh material.

10. The multi-purpose recreational tent according to claim 9 wherein said first end wall and said second end wall are mirror images.

11. The multi-purpose recreational tent according to claim 9 wherein the cover and/or at least one of the walls is layered and wherein one or more of said layers is exposed by opening a flap of a covering adjacent layer.

12. The multi-purpose recreational tent according to claim 11 wherein said opened adjacent layer is retained in an open position by a retaining means on at least one of said tent walls or cover.

13. The multi-purpose recreational tent according to claim 9 wherein a net is secured to at least one of said walls or cover, said net being extendable from one of said walls or cover to a second point on one of said walls or cover, said net further being securable to said second point to retain the net in an extended position.

14. A multi-purpose recreational tent comprising:

a front end wall, a back end wall, a first side wall extending from a first end of the front end wall to a first end of the back end wall, a second side wall extending from a second end of the front end wall to a second end of the back end wall, and an arc-shaped cover secured to the top edge of said end walls and said side walls to cover the enclosure formed by the end walls and side walls, wherein a lower portion of said first end wall comprises a centrally located cutout having a net secured to the surrounding edge of the cutout, a first plurality of vertically spaced apart and differently sized circular cutouts disposed about midway between the first end of the side wall and a first end of the cutout, a second plurality of vertically spaced apart and differently sized rectangular cutouts disposed about midway between the second end of said first end wall and a second end of said centrally located cutout, said first and second plurality of cutouts each having a net secured to the surrounding edge of said first and second cutouts, said first end wall further having an upper area of said sidewall comprising a mesh material, wherein at least a portion of the exterior surface of the cover comprises a plurality of horizontally spaced apart and differently sized circular target areas located on said cover near the point of extension of said cover from said first side wall, said plurality of target areas having a net secured to the surrounding edge of each of said target areas, and wherein at least one of said walls comprises an entrance-way into the interior of said tent.

15. The multi-purpose recreational tent according to claim 14 wherein said cover further comprises a centrally located panel that is removable by a zipper, said panel creating an orifice in said cover when said panel is removed from said cover, said orifice further receiving a screen to allow sunlight and/or ventilation into the inside of the tent.

* * * * *